US007350260B2

(12) United States Patent
Papa

(10) Patent No.: US 7,350,260 B2
(45) Date of Patent: Apr. 1, 2008

(54) MOP WRINGER AND HANDLE STABILIZER

(76) Inventor: Joseph Papa, 1820 E. Kings Hwy., #24, Shreveport, LA (US) 71105

( * ) Notice: Subject to any disclaimer, the term of this patent is extended or adjusted under 35 U.S.C. 154(b) by 0 days.

(21) Appl. No.: 11/330,921

(22) Filed: Jan. 12, 2006

(65) Prior Publication Data

US 2006/0156503 A1 Jul. 20, 2006

Related U.S. Application Data

(60) Provisional application No. 60/643,770, filed on Jan. 14, 2005.

(51) Int. Cl.
*A47L 13/00* (2006.01)

(52) U.S. Cl. ..... 15/260; 211/106; 211/106.01; 248/110; 248/113

(58) Field of Classification Search ..... None
See application file for complete search history.

(56) References Cited

U.S. PATENT DOCUMENTS

| | | | | |
|---|---|---|---|---|
| 2,007,250 A * | 7/1935 | Kellner | 220/212.5 |
| 2,478,291 A * | 8/1949 | Litwaitis | 220/700 |
| 2,851,710 A | 9/1958 | Leach | 15/1 |
| 3,562,841 A * | 2/1971 | Royalty | 15/260 |
| 3,756,451 A | 9/1973 | Popeil | 220/96 |
| 4,722,113 A | 2/1988 | Olsson | 15/264 |
| 4,995,526 A | 2/1991 | Garrison | 220/94 |
| 5,333,353 A * | 8/1994 | Taylor | 15/264 |
| D383,580 S | 9/1997 | Bolster et al. | D32/54 |
| 5,813,567 A | 9/1998 | Mangano | 220/735 |
| 5,941,410 A | 8/1999 | Mangano | 220/735 |
| 5,974,621 A | 11/1999 | Wilen | 15/261 |

* cited by examiner

*Primary Examiner*—David A Redding
(74) *Attorney, Agent, or Firm*—John M. Harrison

(57) ABSTRACT

A mop wringer and handle stabilizer for a mop bucket fitted with a mop wringer and a bucket handle, which in a first embodiment includes a wire clip pivotally mounted on the mop bucket handle and designed for manipulating and tensioning the wire clip on the mop wringer and stabilizing the mop wringer on the mop bucket. A handle bend is optionally provided in the bucket handle for receiving the mop handle of a mop located in the mop bucket and stabilizing the mop in the mop bucket. A wringer handle adaptor is attached to the mop wringer compression handle and is configured and located to optionally receive and stabilize the mop handle when the mop is located in the mop wringer. In a second embodiment the clip element includes a plate shaped to define an engaging member, front leg, top leg and rear leg combination that pivotally mounts on the bucket handle by means of a reverse bend extending from the rear leg. The plate clip selectively engages and disengages the mop wringer and stabilizes the mop wringer on the mop bucket.

7 Claims, 2 Drawing Sheets

MOP WRINGER AND HANDLE STABILIZER

CROSS-REFERENCE TO RELATED APPLICATIONS

This application claims the benefit of and incorporates by reference prior filed copending U.S. Provisional Application Ser. No. 60/643,770, Filed Jan. 14, 2005.

SUMMARY OF THE INVENTION

A mop wringer and handle stabilizer which includes, in a first preferred embodiment, a wire clip pivotally mounted on a mop bucket handle and shaped to selectively tightly engage the front wall or rim of a mop wringer assembly which is removably seated on a mop bucket. The wire clip includes an engaging wire or member that spans a pair of connected front, top and rear legs for removably engaging the rim of the wringer assembly and tensioning the handle of the mop bucket, thus removably stabilizing the mop wringer assembly on the mop bucket using the bucket handle. In another preferred embodiment a round or squared-off handle loop or bend is provided in the bucket handle for removably receiving the mop handle of a mop while the mop is positioned in the mop bucket, to stabilize the mop and mop handle in place during relocation of the mop bucket and mop wringer assembly. In still another preferred embodiment of the invention the clip element is typically constructed of metal plate and is characterized by an engaging member that terminates a front leg or panel, which extends to define a top and rear leg, for selectively engaging the wringer assembly rim. The downwardly-extending rear leg projecting from the top leg is shaped in a reverse-curve to pivotally engage the bucket handle. An enlarged, outwardly-projecting lip typically extends from the engaging member over the mop receptacle in the mop wringer to aid in manipulation of the plate clip on and from the mop wringer assembly.

Tension is applied to the bucket handle and the mop wringer assembly when the bucket handle is rotated or pivoted upwardly to the mop wringer assembly and either the wire clip or the plate clip is secured in a tension-fit to the wringer rim for stabilizing the mop wringer assembly on the mop bucket. In yet another preferred embodiment of the invention the conventional wringer mop compression handle is fitted with a wringer handle adaptor which is shaped and located to optionally receive the handle of a mop located in the mop wringer reservoir and stabilize the mop and mop handle in place.

BRIEF DESCRIPTION OF THE DRAWINGS

The invention will be better understood by reference to the accompanying drawings, wherein.

DESCRIPTION OF THE PREFERRED EMBODIMENTS

Figure 1:
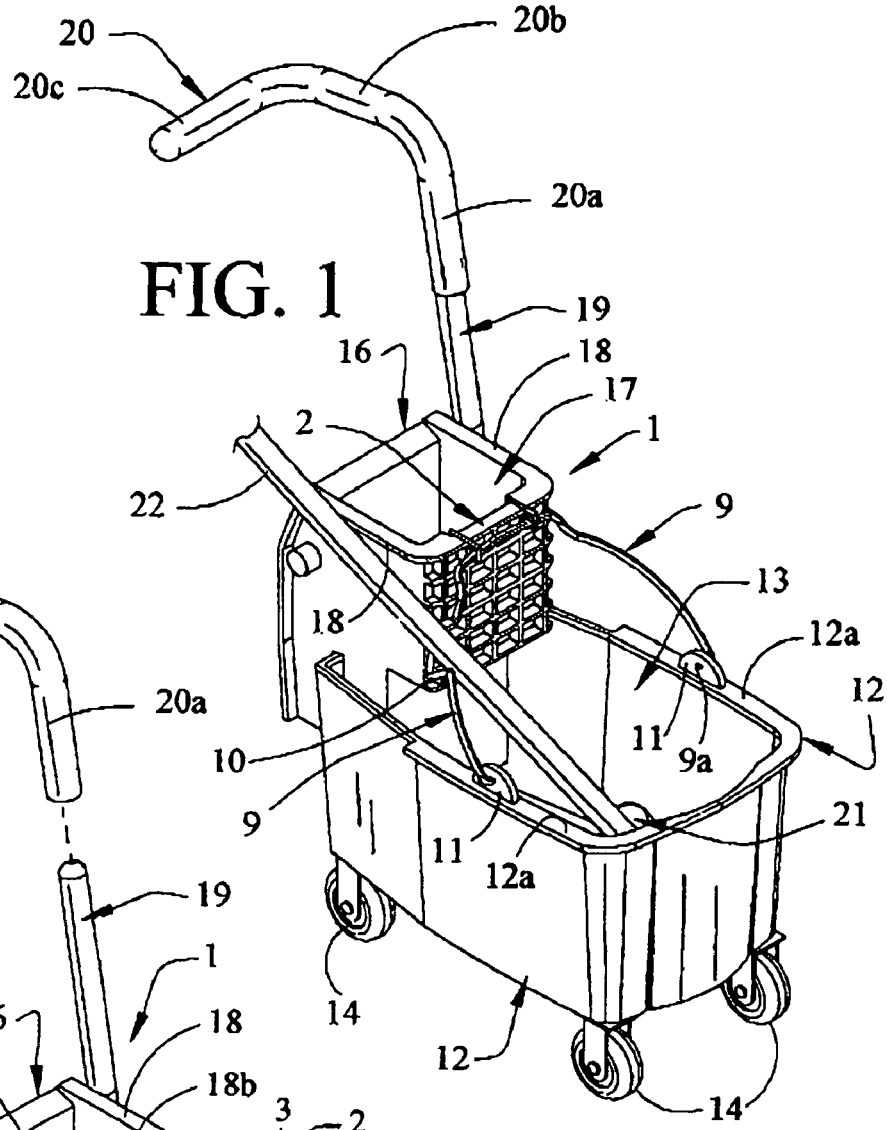
FIG. 1 is a perspective view of a first preferred clip embodiment of the mop wringer and handle stabilizer of this invention, wherein the mop wringer is removably secured in functional configuration on a conventional mop bucket by means of a wire clip using the bucket handle.
Figure 2:
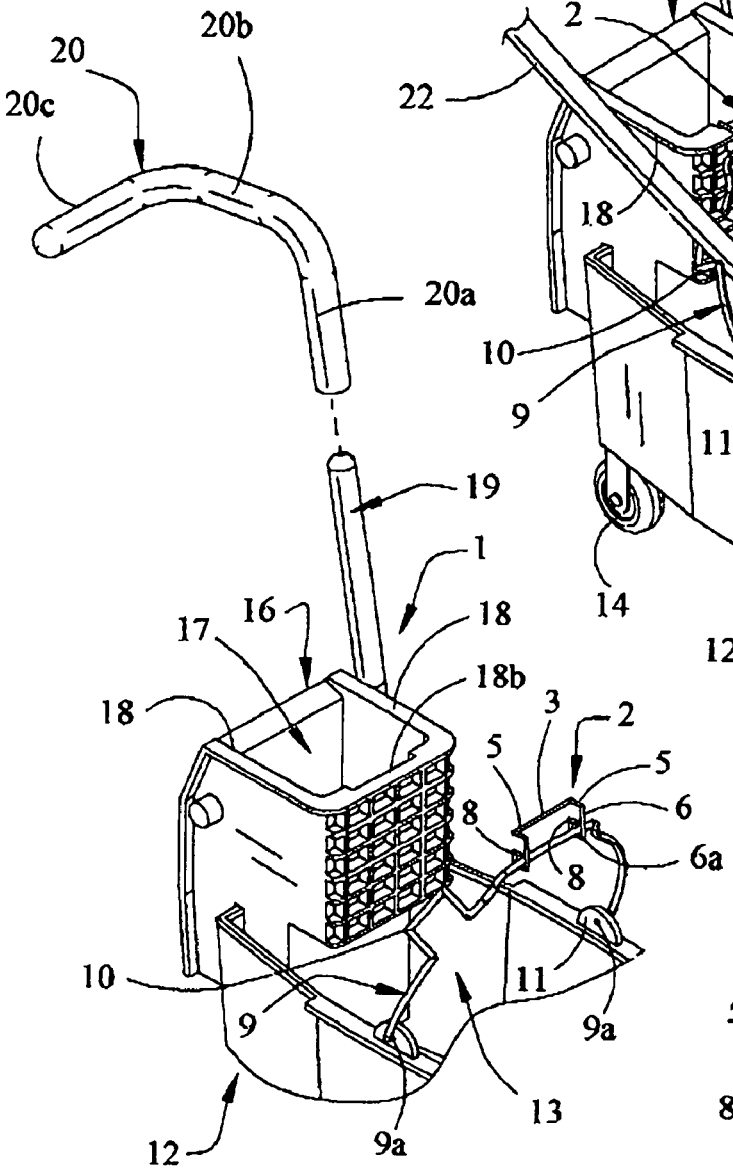
FIG. 2 is a perspective, partially exploded view of a portion of the conventional mop bucket and wringer assembly which illustrates the disengaged mop wringer and handle stabilizer wire clip illustrated in FIG. 1, more particularly illustrating a preferred wire clip and handle design.

Referring initially to FIGS. 1 and 2 of the drawings the mop wringer and handle stabilizer of this invention is generally illustrated by reference numeral 1. The mop wringer and handle stabilizer 1 is typically used in connection with a conventional mop bucket 12 and a companion conventional mop wringer assembly 16, seated on the mop bucket 12, as illustrated in FIGS. 1 and 2.

In a first preferred embodiment of the invention a wire clip 2 is pivotally mounted on the bucket handle 9 of the mop bucket 12 and is shaped to removably engage the frontal portion and recess wall 18*b* of the wringer rim 18 of the conventional mop wringer assembly 16, which is removably fitted in conventional fashion to the bucket rim 12*a* of a mop bucket 12. In a typical application the mop wringer assembly 16 is designed to seat on the rear portion of the bucket rim 12*a* of the mop bucket 12 and receive a conventional mop 21, fitted with a mop handle 22, for wringing the water out of the mop 21 by operation of a conventional mop compression handle 19, provided in the mop wringer assembly 16. Accordingly, the mop receptacle 17 of the mop wringer assembly 16 is sized to receive the mop 21 and facilitate compression of the mop strands (not illustrated) by manipulation of the mop compression handle 19 in conventional fashion. The mop bucket 12 is typically fitted with a reservoir 13 for containing water and/or a detergent (not illustrated) and receiving the mop 21 and wetting the mop 21, pursuant to the mopping of a floor. The mop bucket 12 is typically fitted with conventional rollers 14 for easy transportation and relocation of the mop bucket 12, mop wringer assembly 16 and mop 21 into any desired location for mopping of the floor.

Figure 3:
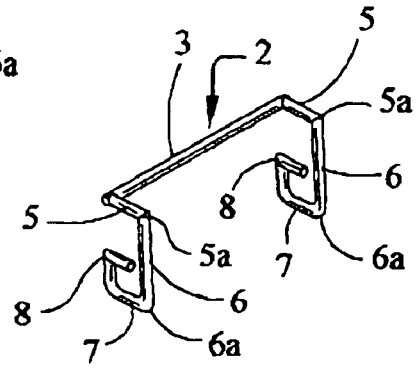
FIG. 3 is a perspective view of the wire clip element of the mop wringer and handle stabilizer illustrated in FIGS. 1 and 2.
Figure 5:
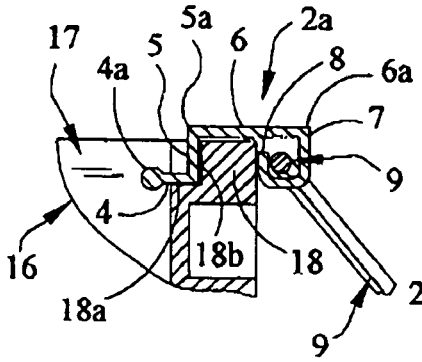
FIG. 5 is a sectional view of the plate clip and wringer environment, taken along line 5-5 in FIG. 4.

As illustrated in FIGS. 1-3 of the drawings, the wire clip 2 is typically shaped to define an engaging member 3 that spans parallel front legs 5, top legs 6 and companion rear legs 7, shaped by front leg bends 5*a* and top leg bends 6*a*, respectively, which fit over and against the frontal portion of the wringer rim 18 of the mop wringer assembly 16, at the recess wall 18*b* (FIG. 2). The spacing between the respective front legs 5 and the rear leg reverse bends 8 in the rear legs 7, respectively, is such that these elements tightly, yet removably engage the wringer rim 18 at the front edge thereof and the recess wall 18*b* of the mop wringer assembly 16. The rear leg reverse bend 8 extends from each of the rear legs 7 and pivotally engages the bucket handle 9, such that the wire clip 2 is pivotally mounted on the bucket handle 9 for selectively engaging and disengaging the wringer rim 18. The bucket handle 9 is typically pivotally attached by means of the mount bend ends 9*a* and aligned mount openings (not illustrated) provided in the corresponding handle mounts 11, to the mop bucket 12 in conventional fashion, as further illustrated in FIGS. 1 and 3 of the drawings.

Figure 4:
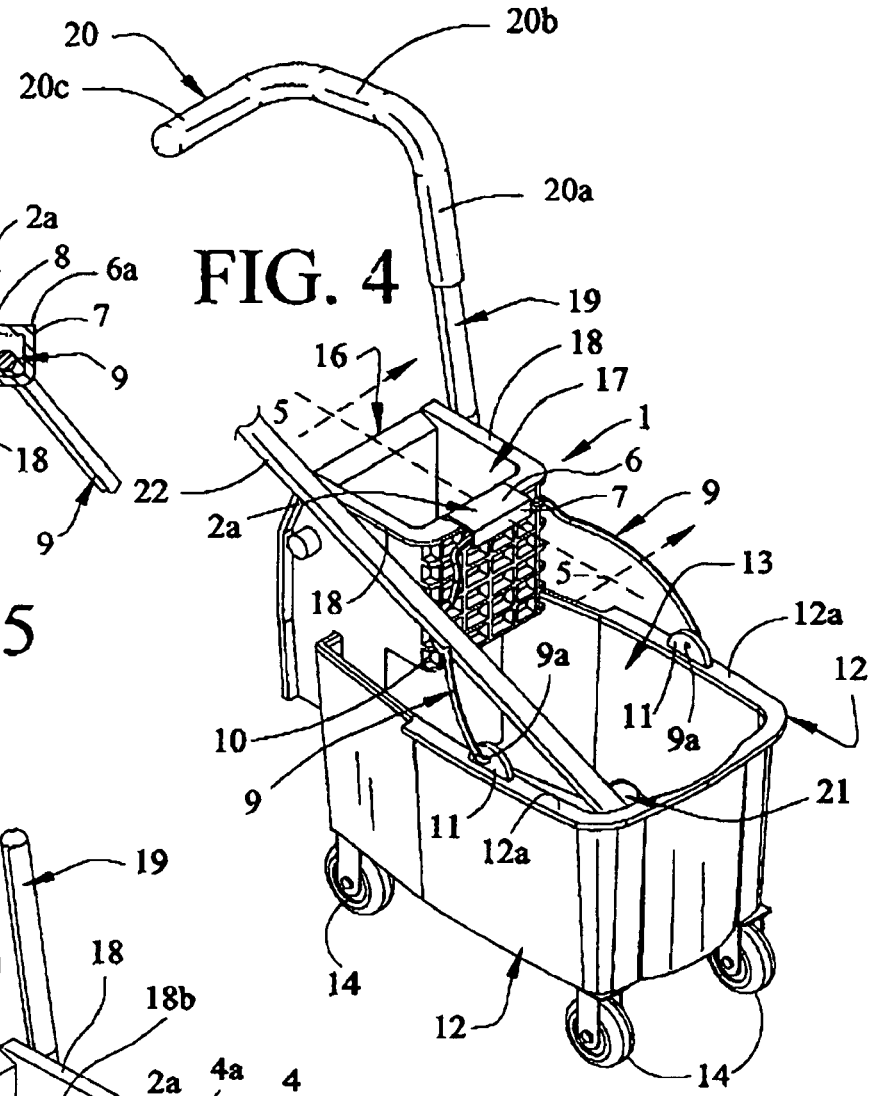
FIG. 4 is a perspective view of a second preferred clip embodiment of the mop wringer and handle stabilizer of this invention secured in functional configuration on a conventional mop bucket wringer assembly by means of a plate clip.
Figure 6:
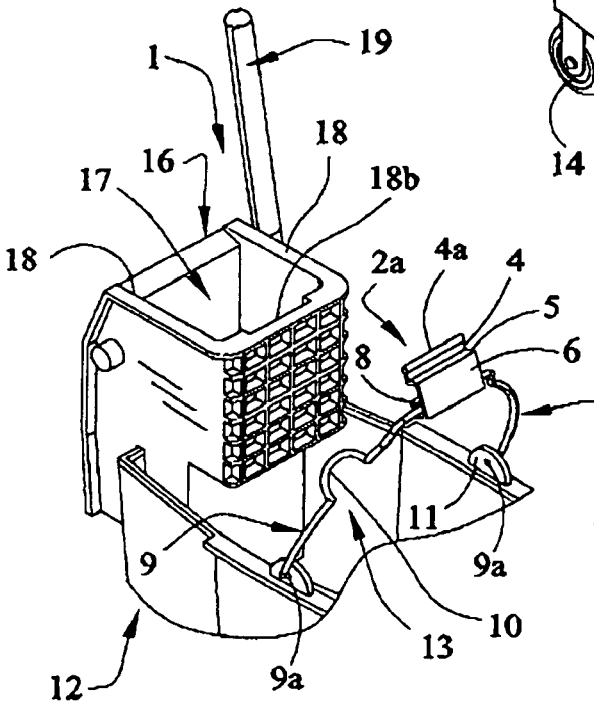
FIG. 6 is a perspective view of a portion of the conventional mop bucket and wringer assembly illustrated in FIG. 4, with the plate clip disengaged from the wringer assembly.
Figure 7:
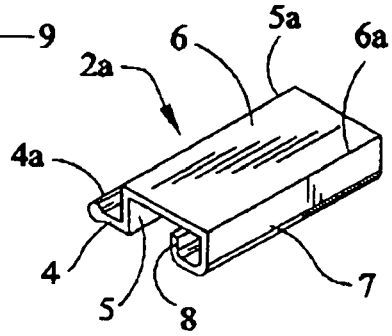
FIG. 7 is a perspective view of the plate clip illustrated in FIGS. 4-6.

In another preferred embodiment of the invention a rounded (FIGS. 4 and 6) or a squared-off (FIGS. 1 and 2) handle bend 10 is provided in the bucket handle 9, between the top central portion thereof and one of the mount bends 9*a* of the bucket handle 9. Accordingly, the tension in the bucket handle 9 when the wire clip 2 is in the engaged configuration illustrated in FIG. 1, results in a downward force applied to the mop wringer assembly 16 to secure the mop wringer assembly 16 on the mop bucket 12. Furthermore, the mop handle 22 of the mop 21 can be inserted or rested in the handle bend 10 of the bucket handle 9 to stabilize the mop 21 and the mop handle 22 in place while the mop 21 is located in the reservoir 13 of the mop bucket 12 and the mop bucket 12 and mop wringer assembly are relocated in concert by operation of the rollers 14, as illustrated in FIG. 1. A second handle bend 10 (not illustrated) can be provided in the opposite segment of the bucket handle 9, as desired.

In yet another preferred embodiment of the invention a typically one-piece, molded plastic wringer handle adaptor 20 is mounted on the extending end of the conventional mop compression handle 19 provided in the mop wringer assembly 16. The wringer handle adaptor 20 includes a typically tubular adaptor base 20*a*, which typically fits over the top end of the mop compression handle 19 and is typically secured in place by glue or by one or more fasteners (not illustrated) or both, as desired. An adaptor offset 20*b* typically extends from the adaptor base 20*a* rearwardly to an adaptor grip 20*c*, which projects substantially parallel to the rear portion of the wringer rim 18. This arrangement facilitates optionally resting the mop handle 22 against the adaptor grip 20*c* when the mop 21 is in the mop receptacle 17 of the mop wringer assembly 16, as an alternative to placement of the mop handle 22 in the handle bend 10 of the bucket handle 9 when the mop is in the reservoir 13, as further illustrated in FIGS. 1 and 4.

In a still further preferred embodiment of the invention the mop wringer and handle stabilizer 1 is characterized by a plate clip 2*a*, typically shaped or stamped from a single piece of metal or an alternative resilient material and defined by an engaging member 4, top leg 6 and rear leg 7, along with a corresponding front leg bend 5*a* and top leg bend 6*a*, and including a rear leg reverse-bend 8 that pivotally engages the bucket handle 9, as illustrated in FIGS. 4-7 of the drawings. In a preferred embodiment an enlarged lip 4*a* is provided in the protruding or forward end of the engaging member 4 and the engaging member 4, as well as the lip 4*a*, project over the mop receptacle 17, beyond the rim recess 18*a* (FIG. 5) of the mop wringer assembly 16, to better facilitate manipulation of the plate clip 2*a* onto and from the wringer rim 18 at the rim recess 18*a* and the recess wall 18*b*. Furthermore, referring again to FIG. 5 of the drawings in a preferred embodiment of the invention the engaging member 4, front legs 5 and top legs 6, as well as the rear leg reverse bend 8 extending from the rear leg 7, of the plate clip 2*a*, are so designed as to fit tightly, yet removably, over the wringer rim 18 of the mop wringer assembly 16 at the rim recess 18*a* and the recess wall 18*b*. This engaging action holds the bucket handle 9 tightly in close proximity to the wringer rim 18 and thus facilitates stability of the entire mop wringer assembly 16 on the mop bucket 12 while the plate clip 2*a* is in the engaged configuration illustrated in FIGS. 4 and 5 of the drawings.

It will be appreciated by those skilled in the art that both the wire clip 2 and the plate clip 2*a*, in both of the embodiments described above, may be designed for installation on a bucket handle 9 of any design to stabilize the mop wringer assembly 16 on the mop bucket 12 without the implementation of a handle bend or bends 10 in the bucket handle 9. However, in a most preferred embodiment of the invention at least one rounded or squared-off handle bend 10 is provided in the bucket handle 9 to further stabilize and seat the mop handle 22 of the mop 21 in position in the mop bucket 12, such that the mop bucket 12, with the mop wringer assembly 16 in place, can be quickly and easily maneuvered and transported by means of the rollers 14, across open spaces and through doorways and narrow openings without risking unpredictable, erratic and even dangerous displacement of the mop handle 22 and the mop 21. Alternatively, the mop handle 22 can be rested against the adaptor grip 20*c* of the wringer handle insert 20 when the mop 21 is located in the mop receptacle 17 of the mop wringer assembly 16, more typically, under circumstances where the mop bucket 12 remains in one place.

As further illustrated in FIGS. 1, 2, 4 and 6 of the drawings it will also be understood that each handle bend 10 can be configured in a bucket handle 9 in a sufficient size and shape to accommodate any sized mop handle 22, carrying a mop 21 on one end thereof, in a slip-fit or a friction-fit, as desired, regardless of the design and size of the mop 21 and the mop handle 22.

While the preferred embodiments of the invention have been described above, it will be recognized and understood that various modifications may be made in the invention and the appended claims are intended to cover all such modifications which may fall within the spirit and scope of the invention.

Having described my invention with the particularity set forth above, what is claimed is:

1. A device for stabilizing a mop having a mop handle in a mop bucket provided with a mop wringer and having a bucket handle, said device comprising a one-piece wire clip constructed so as to pivotally mount on the bucket handle and selectively engaging the mop wringer and exerting tension on the bucket handle and the mop wringer.

2. A mop wringer assembly having a wringer handle, a wringer reservoir and a wringer rim on a mop bucket having a pivoting bucket handle, a bucket reservoir configured to receive a mop having a mop handle, and a stabilizing member, said stabilizer member comprising a wire clip pivotally carried by the bucket handle constructed so as to engage the wringer rim and tension the bucket handle and the mop wringer assembly; at least one handle bend provided in the bucket handle for selectively receiving the mop handle and stabilizing the mop in the bucket reservoir; and a handle adaptor provided on the wringer handle of the mop wringer assembly for maneuvering the mop bucket and the mop wringer assembly in concert and selectively receiving and resting the mop handle when the mop is located in the wringer reservoir of the mop bucket.

3. The stabilizing member of claim 2 wherein said handle adaptor comprises a one-piece member having an adaptor base carried by the wringer handle, an adaptor offset extending from said adaptor base and an adaptor grip projecting from said adaptor offset for said selectively receiving and resting the mop handle.

4. A method for stabilizing a mop wringer on a mop bucket having a bucket handle and a bucket reservoir for receiving a mop having a mop handle, comprising the steps of providing a wire clip pivotally mounted on the bucket handle and selectively engaging the mop wringer and tensioning the bucket handle and the mop wringer.

5. The method according to claim 4 comprising the step of providing at least one bend in the bucket handle of the mop bucket for receiving the mop handle when the mop is located in the bucket reservoir of the mop bucket.

6. The method according to claim 4 comprising the step of providing a handle adaptor on the mop wringer for maneuvering the mop bucket and the mop wringer in concert and receiving and resting the mop handle when the mop is located in the mop wringer.

7. The method according to claim 4 comprising the steps of:

(a) providing at least one bend in the bucket handle of the mop bucket for selectively receiving the mop handle when the mop is located in the bucket reservoir of the mop bucket; and (b) providing a handle adaptor on the mop wringer for maneuvering the mop bucket and the mop wringer in concert and selectively receiving and resting the mop handle when the mop is located in the mop wringer.

* * * * *